US011165138B2

(12) United States Patent
Franco et al.

(10) Patent No.: US 11,165,138 B2
(45) Date of Patent: Nov. 2, 2021

(54) ANTENNA ELEMENT AND RELATED APPARATUS

(71) Applicant: Qorvo US, Inc., Greensboro, NC (US)

(72) Inventors: Marcelo Jorge Franco, Summerfield, NC (US); Ali Tombak, Cary, NC (US); Wolfram C. Stiebler, Munich (DE); Edward T. Spears, Stokesdale, NC (US)

(73) Assignee: Qorvo US, Inc., Greensboro, NC (US)

( * ) Notice: Subject to any disclaimer, the term of this patent is extended or adjusted under 35 U.S.C. 154(b) by 311 days.

(21) Appl. No.: 16/128,648

(22) Filed: Sep. 12, 2018

(65) Prior Publication Data

US 2019/0312335 A1 Oct. 10, 2019

Related U.S. Application Data

(60) Provisional application No. 62/654,860, filed on Apr. 9, 2018.

(51) Int. Cl.
*H01Q 1/38* (2006.01)
*H01Q 21/00* (2006.01)
(Continued)

(52) U.S. Cl.
CPC ..... *H01Q 1/243* (2013.01); *H01Q 3/24* (2013.01); *H01Q 21/0031* (2013.01); *H01Q 21/065* (2013.01)

(58) Field of Classification Search
CPC ..... H01Q 1/243; H01Q 3/24; H01Q 21/0031; H01Q 21/065; H01Q 1/24; H01Q 1/38;
(Continued)

(56) References Cited

U.S. PATENT DOCUMENTS 5,450,090 A * 9/1995 Gels ..... H01Q 9/0414 343/700 MS
6,034,649 A * 3/2000 Wilson ..... H01Q 1/246 343/795

(Continued)

OTHER PUBLICATIONS

Khoshniat, A., et al., "Active Integrated Antenna Supporting Linear and Circular Polarizations," IEEE Transactions on Components, Packaging and Manufacturing Technology, vol. 7, Issue 2, Feb. 2017, pp. 238-245.

(Continued)

*Primary Examiner* — Tho G Phan
(74) *Attorney, Agent, or Firm* — Withrow & Terranova, PLLC

(57) ABSTRACT

An antenna element and related apparatus are provided. The antenna element includes a radiating structure configured to radiate a radio frequency (RF) signal in a defined polarization (e.g., linear polarization or circular polarization). The radiating structure is conductively coupled to a first pair of feed ports and a second pair of feed ports. In examples discussed herein, at least one selected pair of feed ports among the first pair of feed ports and the second pair of feed ports can be dynamically configured to receive a differential signal(s). By applying the differential signal(s) to the selected pair of feed ports with a proper polarity and/or a relative phase differential, it may be possible to cause the radiating structure to radiate in the defined polarization without requiring additional circuitries (e.g., switching circuit), thus helping to reduce power consumption, heat dissipation, and/or footprint in an apparatus employing the antenna element.

23 Claims, 11 Drawing Sheets

(51) Int. Cl.
*H01Q 21/06* (2006.01)
*H01Q 1/24* (2006.01)
*H01Q 3/24* (2006.01)

(58) Field of Classification Search
CPC ..... H01Q 21/00; H01Q 21/06; H01Q 21/24; H01Q 21/245; H01Q 25/00; H01Q 25/001; H01Q 9/16; H01Q 9/42
USPC ..... 343/893
See application file for complete search history.

(56) References Cited

U.S. PATENT DOCUMENTS 6,335,706 B1 * 1/2002 Elliot ..... H01Q 9/30 343/727
6,342,867 B1 * 1/2002 Bell ..... H01Q 19/108 343/795
6,697,019 B1 * 2/2004 Hyuk-Joon ..... H01Q 1/3275 343/700 MS
7,429,952 B2 * 9/2008 Sun ..... H01Q 9/0435 343/700 MS
8,462,071 B1 * 6/2013 Rudish ..... H01Q 1/523 343/797
10,290,930 B2 * 5/2019 Blackadder ..... H01Q 1/28
2005/0206568 A1 * 9/2005 Phillips ..... H01Q 9/0414 343/700 MS
2008/0129619 A1 * 6/2008 Lee ..... H01Q 21/26 343/713
2009/0128413 A1 * 5/2009 Crouch ..... H01Q 3/26 343/700 MS
2010/0321251 A1 * 12/2010 Hesselbarth ..... H01Q 21/06 343/702

OTHER PUBLICATIONS

Lai, J.-Y., et al., "A Wideband CPW-Fed Monopole Antenna with Linear and Circular Polarizations," Proceedings of the 2017 IEEE International Symposium on Antennas and Propagation & USNC/URSI National Radio Science Meeting, Jul. 9-14, 2017, San Diego, California, USA, pp. 327-328.
Parthiban, P., et al., "Low-Cost Low-Profile UHF RFID Reader Antenna with Reconfigurable Beams and Polarizations," Proceedings of the 2017 IEEE International Conference on RFID (RFID), May 9-11, 2017, Phoenix, Arizona, USA, pp. 81-87.
Wong, H., et al., "LP and CP Polarization Reconfigurable Antennas for Modern Wireless Applications," Proceedings of the 2017 International Symposium on Antennas and Propagation (ISAP), Oct. 30-Nov. 2, 2017, Phuket, Thailand, pp. 1-2.
Yang, Y., et al., "Design of a dual-band linear-circular-polarization microstrip antenna," Proceedings of the 2013 International Conference on Computational Problem-Solving (ICCP), Oct. 26-28, 2013, Jiuzhai, China, pp. 295-298.

* cited by examiner

ANTENNA ELEMENT AND RELATED APPARATUS

RELATED APPLICATIONS

This application claims the benefit of provisional patent application Ser. No. 62/654,860, filed on Apr. 9, 2018, the disclosure of which is hereby incorporated herein by reference in its entirety.

FIELD OF THE DISCLOSURE

The technology of the disclosure relates generally to an antenna structure(s).

BACKGROUND

Mobile communication devices have become increasingly common in current society for providing wireless communication services. The prevalence of these mobile communication devices is driven in part by the many functions that are now enabled on such devices. Increased processing capabilities in such devices means that mobile communication devices have evolved from being pure communication tools into sophisticated mobile multimedia centers that enable enhanced user experiences.

A mobile communication device includes a transmitting antenna element(s) configure to radiate a radio frequency (RF) signal(s) into space. The transmitting antenna element(s) can be configured to radiate the RF signal(s) in a specific antenna polarization, such as horizontal polarization, vertical polarization, circular polarization, and so on. Notably, for the RF signal(s) to be absorbed properly by a receiving antenna element(s) in a receiving device (e.g., a base station), the transmitting antenna element(s) needs to radiate the RF signal(s) in a polarization that is substantially similar to the polarization of the receiving antenna element(s). For example, if the receiving antenna element(s) is configured to absorb the RF signal(s) based on horizontal polarization, then the transmit antenna element(s) should be configured to radiate the RF signal(s) in horizontal polarization as well. In this regard, the transmitting antenna element(s) may need to dynamically change antenna polarization based on respective antenna polarization of an intended receiving antenna element(s).

A conventional mobile communication device may be designed to include a number of antenna elements preconfigured to operate in different antenna polarizations. For example, the conventional mobile communication device may include a pair of antenna elements preconfigured to transmit the RF signal(s) in horizontal and vertical polarizations, respectively. Accordingly, a switching circuit may be provided in the conventional mobile communication device to dynamically toggle between the pair of antenna elements based on the polarization of the intended receiving antenna element(s). However, the switching circuit may introduce insertion losses that may lead to a raised noise floor and a reduced signal-to-noise ratio (SNR). Furthermore, the increased number of antenna element(s) may require adding additional power amplifiers, which can lead to increased power consumption, heat dissipation, and footprint. As such, it may be desirable to dynamically reconfigure an antenna element(s) to operate based on different antenna polarizations without the addition of the switching circuit and/or the additional antenna element(s).

SUMMARY

Embodiments of the disclosure relate to an antenna element and related apparatus. The antenna element includes a radiating structure configured to radiate a radio frequency (RF) signal in a defined polarization (e.g., linear polarization or circular polarization). The radiating structure is conductively coupled to a first pair of feed ports and a second pair of feed ports. In examples discussed herein, at least one selected pair of feed ports among the first pair of feed ports and the second pair of feed ports can be dynamically configured to receive a differential signal(s). By applying the differential signal(s) to the selected pair of feed ports with proper polarity and/or relative phase differential, it may be possible to cause the radiating structure to radiate in the defined polarization without requiring additional circuitries (e.g., switching circuit), thus helping to reduce power consumption, heat dissipation, and/or footprint in an apparatus employing the antenna element.

In one aspect, an antenna element is provided. The antenna element includes a radiating structure configured to radiate in a defined polarization. The antenna element also includes a first pair of feed ports conductively coupled to the radiating structure. The first pair of feed ports is disposed linearly in a first axis parallel to the radiating structure. The antenna element also includes a second pair of feed ports conductively coupled to the radiating structure. The second pair of feed ports is disposed linearly in a second axis parallel to the radiating structure and perpendicular to the first axis. At least one selected pair of feed ports among the first pair of feed ports and the second pair of feed ports is configured to receive a differential signal to cause the radiating structure to radiate in the defined polarization.

In another aspect, an antenna apparatus is provided. The antenna apparatus includes an antenna element. The antenna element includes a radiating structure configured to radiate in a defined polarization. The antenna element also includes a first pair of feed ports conductively coupled to the radiating structure. The first pair of feed ports is disposed linearly in a first axis parallel to the radiating structure. The antenna element also includes a second pair of feed ports conductively coupled to the radiating structure. The second pair of feed ports is disposed linearly in a second axis parallel to the radiating structure and perpendicular to the first axis. The antenna apparatus also includes a control circuit configured to cause a differential signal being provided to at least one selected pair of feed ports among the first pair of feed ports and the second pair of feed ports to cause the radiating structure to radiate in the defined polarization.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1B:
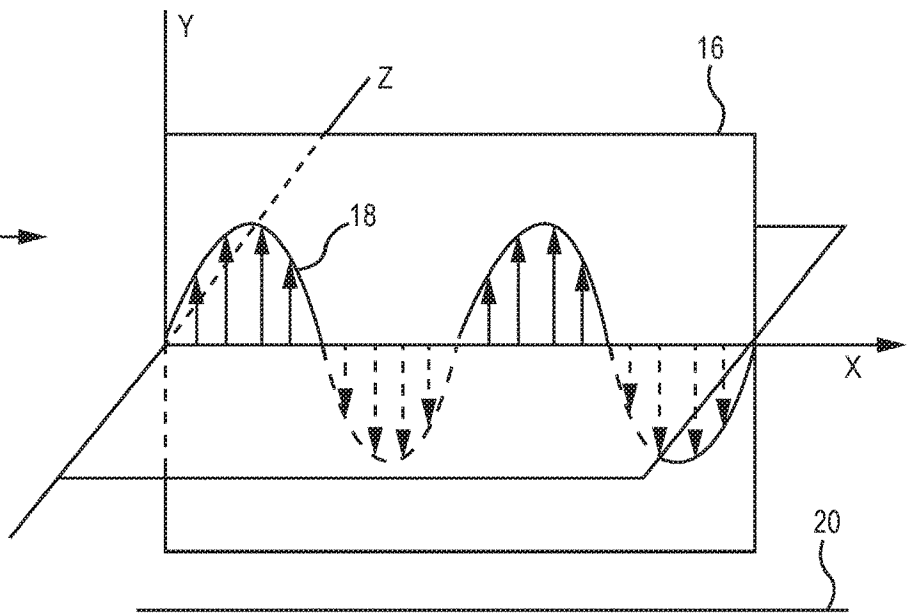
FIG. 1B (PRIOR ART)
FIG. 1B is a schematic diagram providing an exemplary illustration of a vertical E-field plane of an electromagnetic wave.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Embodiments of the disclosure relate to an antenna element and related apparatus. The antenna element includes a radiating structure configured to radiate a radio frequency (RF) signal in a defined polarization (e.g., linear polarization or circular polarization). The radiating structure is conductively coupled to a first pair of feed ports and a second pair of feed ports. In examples discussed herein, at least one selected pair of feed ports among the first pair of feed ports and the second pair of feed ports can be dynamically configured to receive a differential signal(s). By applying the differential signal(s) to the selected pair of feed ports with proper polarity and/or relative phase differential, it may be possible to cause the radiating structure to radiate in the defined polarization without requiring additional circuitries (e.g., switching circuit), thus helping to reduce power consumption, heat dissipation, and/or footprint in an apparatus employing the antenna element.

Figure 1A:
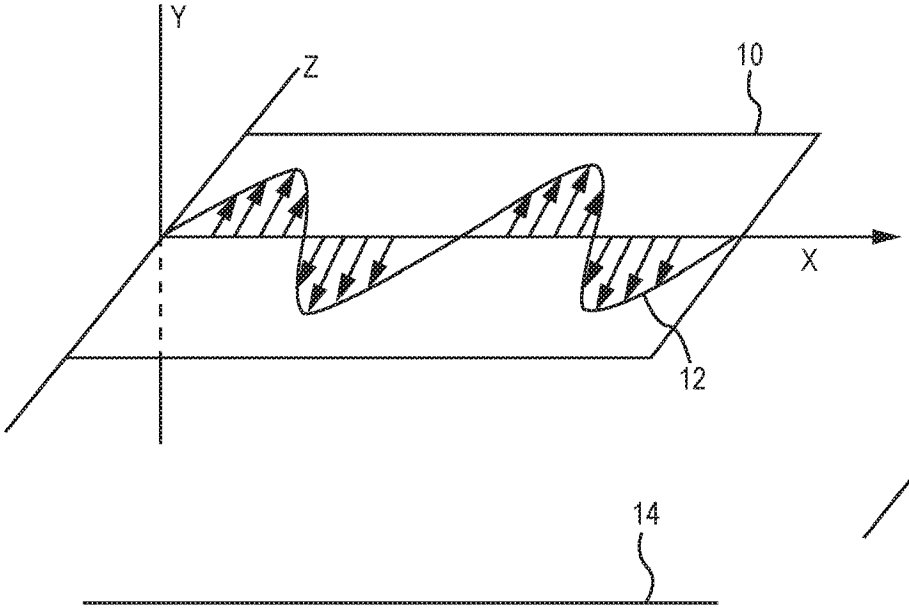
FIG. 1A (PRIOR ART)
FIG. 1A is a schematic diagram providing an exemplary illustration of a horizontal electrical field (E-field) plane of an electromagnetic wave.

Before discussing the antenna element and related apparatus of the present disclosure, a brief overview of antenna polarization is provided with reference to FIGS. 1A and 1B. The discussion of specific exemplary aspects of an antenna element and related apparatus according to the present disclosure starts below with reference to FIG. 2A.

FIG. 1A is a schematic diagram providing an exemplary illustration of a horizontal electrical field (E-field) plane 10 of an electromagnetic wave 12. Notably, the electromagnetic wave 12 can be modulated to carry information. As such, the electromagnetic wave 12 can also be referred to as an RF signal. The electromagnetic wave 12 traverses in a propagation direction X wholly in the horizontal E-field plane 10, which is parallel to a horizon 14. Accordingly, an antenna element (not shown) radiating the electromagnetic wave 12 in the propagation direction X is said to be operating in a linear horizontal polarization.

FIG. 1B is a schematic diagram providing an exemplary illustration of a vertical E-field plane 16 of an electromagnetic wave 18. The electromagnetic wave 18 traverses in a propagation direction X wholly in the vertical E-field plane 16, which is perpendicular to a horizon 20. Accordingly, an antenna element (not shown) radiating the electromagnetic wave 18 in the propagation direction X is said to be operating in a linear vertical polarization.

Notably, the electromagnetic wave 18 may traverse in the propagation direction X wholly in an E-field plane that is neither parallel nor perpendicular to the horizon 20. For example, the E-field plane may have a 45° or a 135° angle relative to the horizon 20. Hereinafter, an E-field plane that is neither parallel nor perpendicular to the horizon 20 is referred to as an angled E-field plane. Accordingly, an antenna element radiating the electromagnetic wave in the angled E-field plane is said to be in a linear angled polarization.

In addition to radiating an electromagnetic wave in the propagation direction X in linear polarization (e.g., linear horizontal polarization as shown in FIG. 1A or linear vertical polarization as shown in FIG. 1B), an antenna element can also radiate an electromagnetic wave in circular polarization. In a circular polarized antenna element, the E-field plane rotates in a circle making one complete revolution during one period of an electromagnetic wave. If the rotation is clockwise looking in the propagation direction X, the sense is called right-hand-circular (RHC). In contrast, if the rotation is counterclockwise in the propagation direction X, the sense is called left-hand-circular (LHC).

A circular polarized wave radiates energy in both the horizontal and vertical planes and all planes in between. The difference, if any, between the maximum and the minimum peaks as the antenna is rotated through all angles, is called the axial ratio or ellipticity and is usually specified in decibels (dB). If the axial ratio is near 0 dB, the antenna element is said to be circular polarized. If the axial ratio is greater than zero (e.g., 1 dB), the polarization can be referred to as elliptical.

As discussed earlier, a conventional device may employ a number of antenna elements preconfigured to radiate the electromagnetic wave in a number of polarizations (e.g., linear horizontal polarization, linear vertical polarization, circular polarization, etc.), respectively. Further, the conventional device may have to employ a switching circuit(s) to toggle between the preconfigured antenna elements. Since the switching circuit(s) may introduce insertion losses that can lead to a raised noise floor and a reduced signal-to-noise ratio (SNR). As such, it may be desirable to dynamically reconfigure an antenna element(s) to radiate an RF signal(s) in a defined antenna polarization without requiring additional switching circuits and/or antenna elements.

In examples discussed hereinafter, an antenna element includes a radiating structure configured to radiate an electromagnetic wave in a defined polarization (e.g., linear horizontal polarization, linear vertical polarization, linear angled polarization, and circular polarization). Notably, the radiating structure can be implemented based on any suitable number and type of antenna (e.g., monopole antenna, dipole antenna, patch antenna, etc.) configured in any suitable geometric shape (e.g., rectangular, circular, etc.) without changing operational principles of the present disclosure. Further, the radiating structure can be provided in a two-dimensional (2D) or a three-dimensional (3D) structure.

The antenna element includes a first pair of feed ports and a second pair of feed ports. The first pair of feed ports and the second pair of feed ports are conductively coupled to the radiating structure. The first pair of feed ports and the second pair of feed ports can be disposed based on any suitable arrangement without changing the operational principle of the antenna structure. For example, the first pair of feed ports can be linearly aligned in a first axis parallel to the radiating structure. The second pair of feed ports can be linearly aligned in a second axis parallel to the radiating structure but perpendicular to the first axis. The first axis and the second axis may intercept at a defined geometric center of the radiating structure. As such, the first pair of feed ports and the second pair of feed ports are symmetric relative to the defined geometric center of the radiating structure. Notably, it may also be possible to provide the first pair of feed ports and the second pair of feed ports in an asymmetrical arrangement relative to the defined geometric center of the radiating structure.

The antenna element can be dynamically reconfigured to radiate in the defined polarization by providing a differential signal(s) to at least one selected pair of feed ports among the first pair of feed ports and the second pair of feed ports. In this regard, the differential signal(s) can be provided to the first pair of feed ports, the second pair of feed ports, or both the first pair of feed ports and the second pair of feed ports. By controlling the polarity and/or relative phase of the differential signal(s), it may be possible to cause the radiating structure to radiate in the defined polarization. As a result, an antenna apparatus employing the antenna element can be configured to support a number of antenna polarizations without requiring additional circuitries (e.g., switching circuit), thus helping to reduce power consumption, heat dissipation, and/or footprint in the antenna apparatus.

Figure 2A:
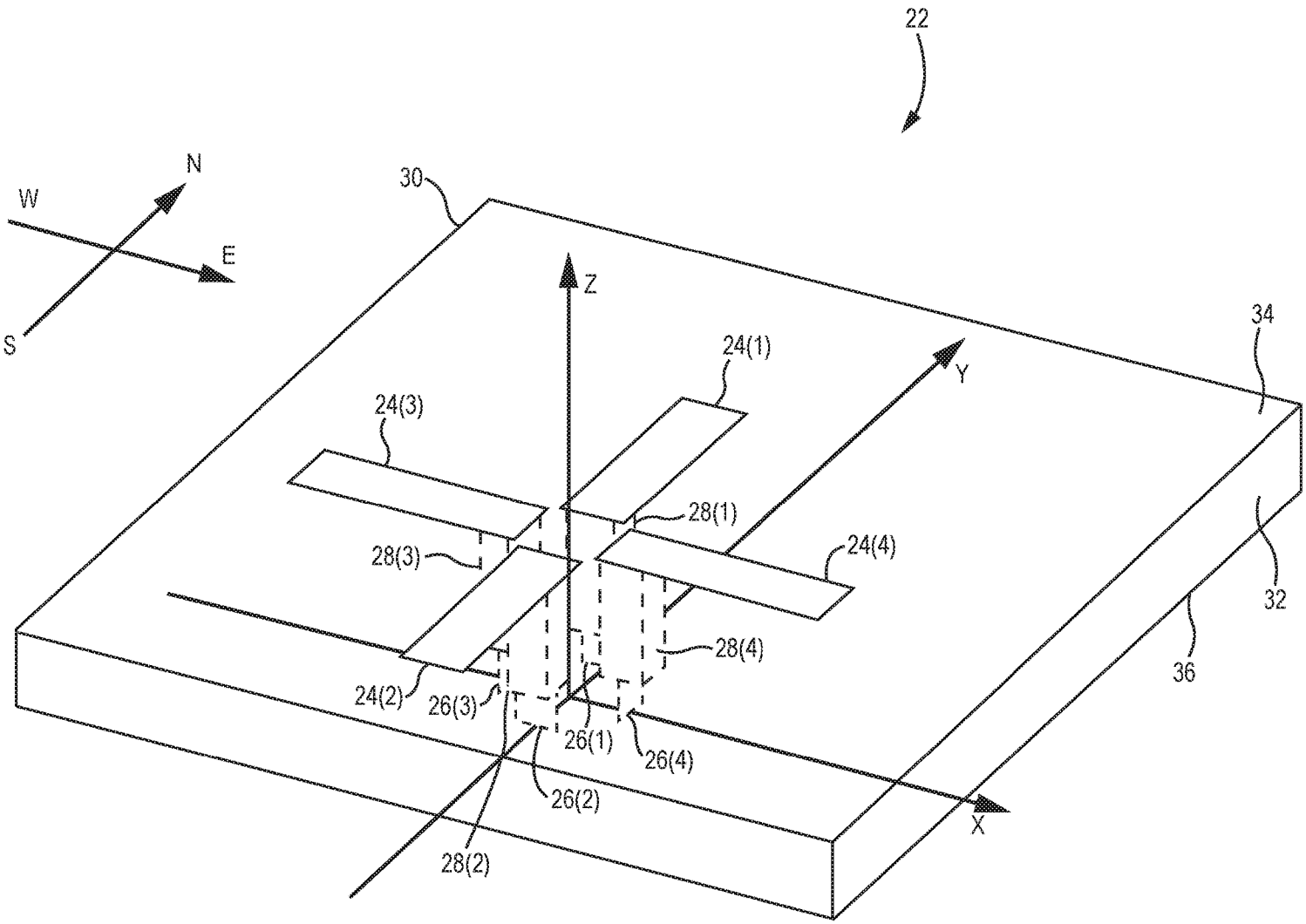
FIG. 2A is a schematic diagram providing a three-dimensional (3D) view of an exemplary antenna element configured according to one embodiment of the present disclosure.

In this regard, FIG. 2A is a schematic diagram providing a 3D view of an exemplary antenna element 22 configured according to one embodiment of the present disclosure. The antenna element 22 includes a first rectangular-shaped monopole antenna 24(1), a second rectangular-shaped monopole antenna 24(2), a third rectangular-shaped monopole antenna 24(3), and a fourth rectangular-shaped monopole antenna 24(4) that collectively form the radiating structure of the antenna element 22. Each of the first rectangular-shaped monopole antenna 24(1), the second rectangular-shaped monopole antenna 24(2), the third rectangular-shaped monopole antenna 24(3), and the fourth rectangular-shaped monopole antenna 24(4) can be in any suitable length, width, and height. Notably, the height of the radiating structure may cause a radiation pattern of the antenna element 22 to change in a Z dimension. Given that a smaller height may reduce efficiency of the radiating structure and a greater height may create additional side lobes, it may be desirable for the radiating structure to have a height between 0.125 and 0.5 wavelengths such that the antenna element 22 can form a uniform radiation pattern in the Z dimension.

The antenna element 22 includes a first pair of feed ports 26(1), 26(2) and a second pair of feed ports 26(3), 26(4). The first pair of feed ports 26(1), 26(2) is conductively coupled to the first rectangular-shaped monopole antenna 24(1) and the second rectangular-shaped monopole antenna 24(2) by a first pair of conductive structures 28(1), 28(2), respectively. The second pair of feed ports 26(3), 26(4) is conductively coupled to the third rectangular-shaped monopole antenna 24(3) and the fourth rectangular-shaped monopole antenna 24(4) by a second pair of conductive structures 28(3), 28(4), respectively.

The antenna element 22 may be provided in a 3D structure 30 that includes a substrate layer 32. In a non-limiting example, the first rectangular-shaped monopole antenna 24(1), the second rectangular-shaped monopole antenna 24(2), the third rectangular-shaped monopole antenna 24(3), and the fourth rectangular-shaped monopole antenna 24(4) can be disposed on a first surface 34 (e.g., top surface) of the substrate layer 32, while the first pair of feed ports 26(1), 26(2) and the second pair of feed ports 26(3), 26(4) are provided on a second surface 36 (e.g., bottom surface) of the substrate layer 32. In this regard, the first pair of conductive structures 28(1), 28(2) and the second pair of conductive structures 28(3), 28(4) can be conductive vias that extend vertically through the substrate layer 32. Notably, the conductive vias can be provided in any suitable shape (e.g., cylinder, cuboid, hexagonal prism, and so on) and formed with any suitable conductive material.

The first rectangular-shaped monopole antenna 24(1) and the second rectangular-shaped monopole antenna 24(2) can be linearly aligned along a first axis Y. The third rectangular-shaped monopole antenna 24(3) and the fourth rectangular-shaped monopole antenna 24(4) can be linearly aligned along a second axis X. In examples discussed hereinafter, the first axis Y is a north-south oriented axis and the second axis X is a west-east oriented axis. Accordingly, the first rectangular-shaped monopole antenna 24(1) and the second rectangular-shaped monopole antenna 24(2) are linearly aligned in a north-south orientation, and the third rectangular-shaped monopole antenna 24(3) and the fourth rectangular-shaped monopole antenna 24(4) are linearly aligned in a west-east orientation.

Figure 2B:
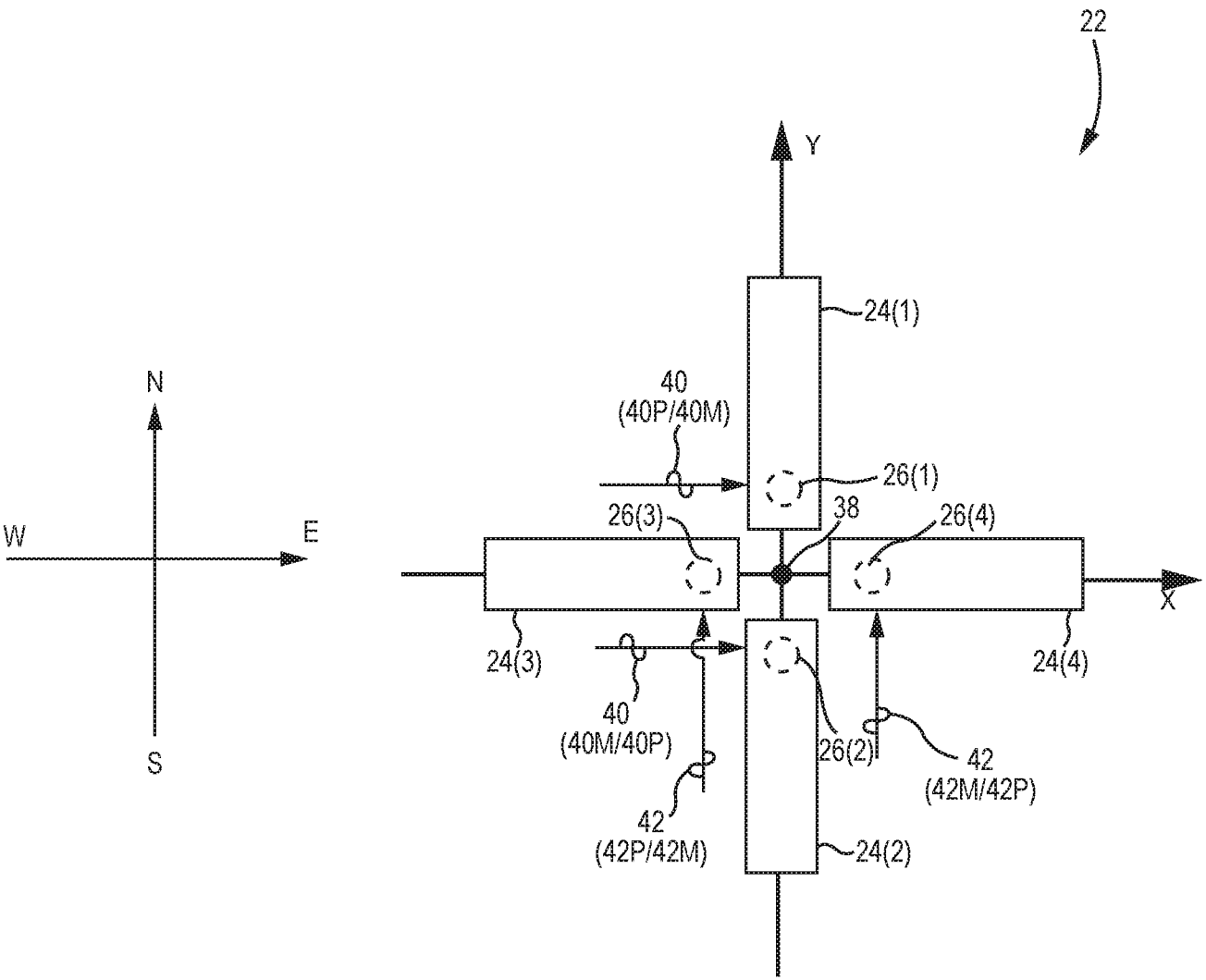
FIG. 2B is a schematic diagram providing an exemplary top view of the antenna element of FIG. 2A.

FIG. 2B is a schematic diagram providing an exemplary top view of the antenna element 22 of FIG. 2A. Common elements between FIGS. 2A and 2B are shown therein with common element numbers and will not be re-described herein.

The first pair of feed ports 26(1), 26(2) may be linearly aligned with the first axis Y and thus being north-south oriented. The second pair of feed ports 26(3), 26(4) may be linearly aligned with the second axis Y and thus being west-east oriented. In a non-limiting example, the first rectangular-shaped monopole antenna 24(1), the second rectangular-shaped monopole antenna 24(2), the third rectangular-shaped monopole antenna 24(3), and the fourth rectangular-shaped monopole antenna 24(4) are symmetrical relative to a geometric center 38. Accordingly, the first pair of feed ports 26(1), 26(2) and the second pair of feed ports 26(3), 26(4) are also symmetric relative to the geometric center 38.

The first rectangular-shaped monopole antenna 24(1) and the second rectangular-shaped monopole antenna 24(2) form a first dipole antenna. Likewise, the third rectangular-shaped monopole antenna 24(3) and the fourth rectangular-shaped monopole antenna 24(4) form a second dipole antenna. In this regard, the radiating structure in the antenna element 22 actually includes a pair of dipole antennas deployed in an X-shape.

In one embodiment, the first pair of feed ports 26(1), 26(2) is configured to receive a first differential signal 40. The second pair of feed ports 26(3), 26(4) is configured to receive a second differential signal 42. In this regard, it is possible to employ a pair of differential amplifiers (not shown) to provide the first differential signal 40 and the second differential signal 42 to the first pair of feed ports 26(1), 26(2) and the second pair of feed ports 26(3), 26(4), respectively. Alternatively, it may also be possible to employ four single-ended amplifiers to provide four single-ended signals (not shown) to the first pair of feed ports 26(1), 26(2) and the second pair of feed ports 26(3), 26(4), respectively. It should be appreciated that the pair of differential amplifiers can be provided as a pair of power sources. Likewise, the four single-ended amplifiers can be provided as four single-ended power sources.

Regardless whether the first pair of feed ports 26(1), 26(2) and the second pair of feed ports 26(3), 26(4) are driven by the pair of differential amplifiers or the four single-ended amplifiers, each of the first pair of feed ports 26(1), 26(2) and the second pair of feed ports 26(3), 26(4) receives a respective signal having a respective power. The antenna element 22 is configured to combine the respective power received by the first pair of feed ports 26(1), 26(2) and the second pair of feed ports 26(3), 26(4) spatially, despite that the radiating structure in the antenna element 22 appears to be a single X-shaped dipole antenna. In this regard, it may be possible to eliminate the need for switches and/or amplifiers dedicated to provide vertical or horizontal polarization feeds, thus helping to achieve better efficiency in the antenna element 22. Further, by combining the respective power received by the first pair of feed ports 26(1), 26(2) and the second pair of feed ports 26(3), 26(4), it may be possible to employ relatively smaller amplifiers, thus helping to reduce complexity, footprint, power consumption, and/or heat dissipation in a system employing the antenna element 22.

In a non-limiting example, the first differential signal 40 and the second differential signal 42 each includes a pair of signals in opposing polarities. In this regard, the first differential signal 40 includes a first positive signal 40P and a first negative signal 40M. Likewise, the second differential signal 42 includes a second positive signal 42P and a second negative signal 42M.

In one non-limiting example, only the first differential signal 40 is provided to the first pair of feed ports 26(1), 26(2). As a result, only the first rectangular-shaped monopole antenna 24(1) and the second rectangular-shaped monopole antenna 24(2) will be excited to radiate an electromagnetic wave in a north-south oriented linear polarization. If the first axis Y is provided perpendicular to the horizon, then the first rectangular-shaped monopole antenna 24(1) and the second rectangular-shaped monopole antenna 24(2) will be radiating the electromagnetic wave in a linear vertical polarization.

In another non-limiting example, only the second differential signal 42 is provided to the second pair of feed ports 26(3), 26(4). As a result, only the third rectangular-shaped monopole antenna 24(3) and the fourth rectangular-shaped monopole antenna 24(4) will be excited to radiate the electromagnetic wave in a west-east oriented linear polarization. If the second axis X is provided horizontal to the horizon, then the third rectangular-shaped monopole antenna 24(3) and the fourth rectangular-shaped monopole antenna 24(4) will be radiating the electromagnetic wave in a linear horizontal polarization.

As discussed next in FIGS. 3A-3D, it is also possible to reconfigure the antenna element 22 to radiate in linear angled polarization by providing the first differential signal 40 and the second differential signal 42 with proper polarities. Common elements between FIGS. 2B and 3A-3D are shown therein with common element numbers and will not be re-described herein.

Figure 3B:
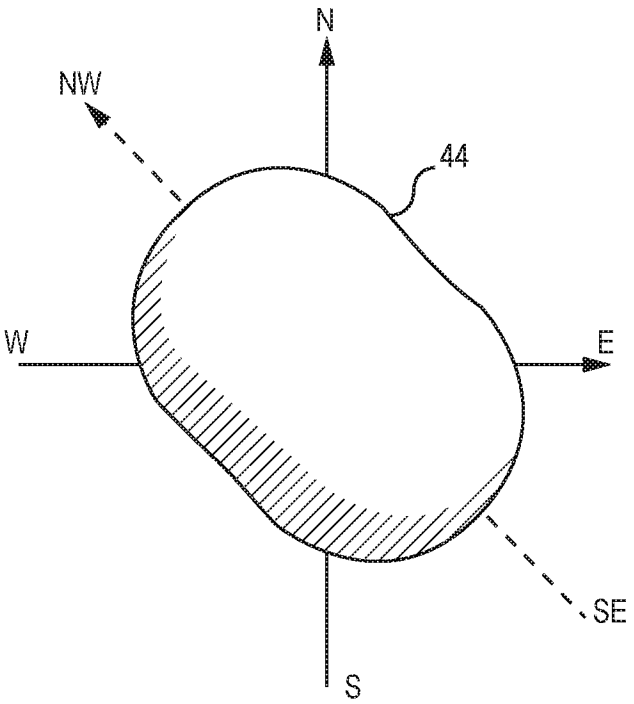
FIG. 3B is a schematic diagram providing an exemplary illustration of an antenna pattern generated by the antenna element of FIGS. 2A and 2B in a northwest-southeast orientation.
Figure 3A:
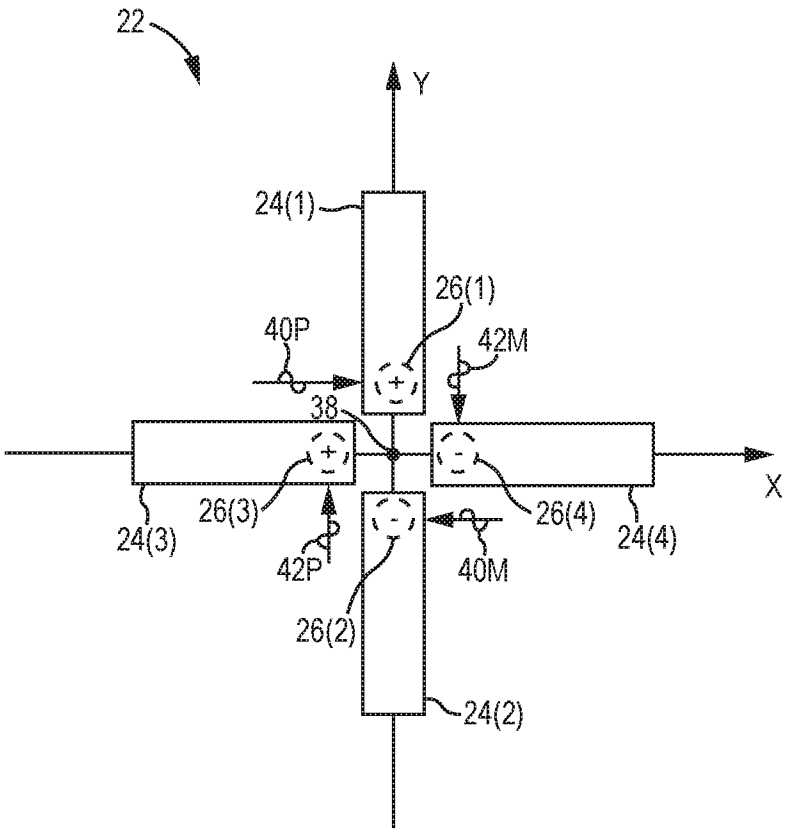
FIG. 3A is a schematic diagram providing an exemplary illustration of the antenna element of FIGS. 2A and 2B configured to radiate in a northwest-southeast oriented linear polarization.

FIG. 3A is a schematic diagram providing an exemplary illustration of the antenna element 22 of FIGS. 2A and 2B configured to radiate in a northwest-southeast oriented linear polarization. In this regard, the first pair of feed ports 26(1), 26(2) are configured to receive the first positive signal 40P and the first negative signal 40M, respectively. Concurrently, the second pair of feed ports 26(3), 26(4) are configured to receive the second positive signal 42P and the second negative signal 42M, respectively. As discussed in FIGS. 7A and 7B below, the first differential signal 40 and the second differential signal 42 are so generated to have a 0° relative phase differential.

As such, the first rectangular-shaped monopole antenna 24(1) and the third rectangular-shaped monopole antenna 24(3) collectively form a northwest (NW) facing L-shaped monopole antenna that receives the first positive signal 40P and the second positive signal 42P. Similarly, the second rectangular-shaped monopole antenna 24(2) and the fourth rectangular-shaped monopole antenna 24(4) collectively form a southeast (SE) facing L-shaped monopole antenna that receives the first negative signal 40M and the second negative signal 42M. In this regard, the radiating structure includes the NW facing L-shaped monopole antenna and the SE facing monopole antenna that collectively form a dipole antenna in a northwest-southeast orientation. Accordingly, the antenna element 22 can radiate the electromagnetic wave in a linear angled polarization in the northwest-southeast orientation. FIG. 3B is a schematic diagram providing an exemplary illustration of an antenna pattern 44 generated by the antenna element 22 of FIGS. 2A and 2B in the northwest-southeast orientation.

Figure 3D:
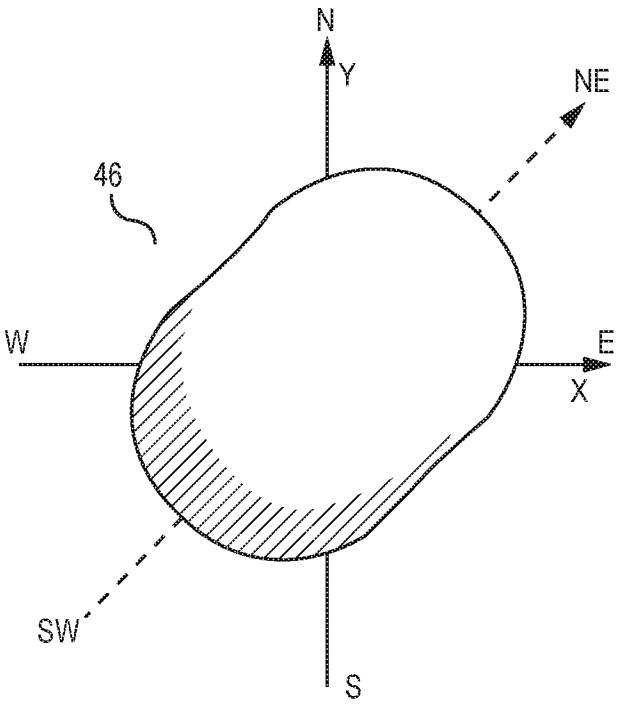
FIG. 3D is a schematic diagram providing an exemplary illustration of an antenna pattern generated by the antenna element of FIGS. 2A and 2B in the northeast-southwest orientation.
Figure 3C:
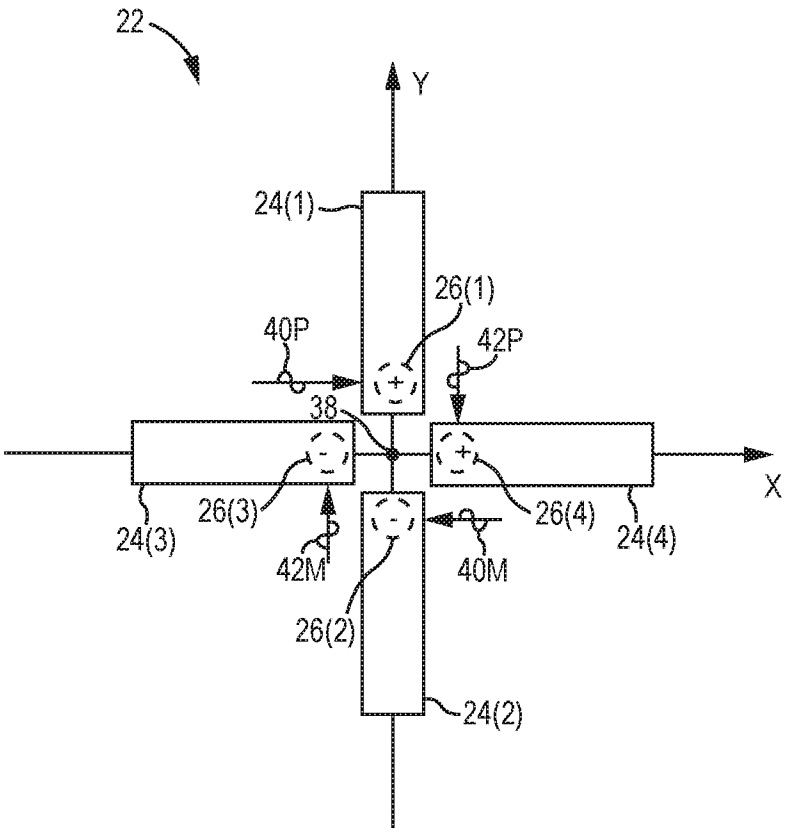
FIG. 3C is a schematic diagram providing an exemplary illustration of the antenna element of FIGS. 2A and 2B configured to radiate in a northeast-southwest oriented linear polarization.

FIG. 3C is a schematic diagram providing an exemplary illustration of the antenna element 22 of FIGS. 2A and 2B configured to radiate in a northeast-southwest oriented linear polarization. In this regard, the first pair of feed ports 26(1), 26(2) are configured to receive the first positive signal 40P and the first negative signal 40M, respectively. Concurrently, the second pair of feed ports 26(3), 26(4) is configured to receive the second negative signal 42M and the second positive signal 42P, respectively. As discussed in FIGS. 7A and 7B below, the first differential signal 40 and the second differential signal 42 are so generated to have a 0° relative phase differential.

As such, the first rectangular-shaped monopole antenna 24(1) and the fourth rectangular-shaped monopole antenna 24(4) collectively form a northeast (NE) facing L-shaped monopole antenna receiving the first positive signal 40P and the second positive signal 42P. Similarly, the second rectangular-shaped monopole antenna 24(2) and the third rectangular-shaped monopole antenna 24(3) collectively form a southwest (SW) facing L-shaped monopole antenna receiving the first negative signal 40M and the second negative signal 42M. In this regard, the radiating structure includes the NE facing L-shaped monopole antenna and the SW facing monopole antenna that collectively form a dipole antenna in a northeast-southwest orientation. Accordingly, the antenna element 22 can radiate an electromagnetic wave in a linear angled polarization in the northeast-southwest orientation. FIG. 3D is a schematic diagram providing an exemplary illustration of an antenna pattern 46 generated by the antenna element 22 of FIGS. 2A and 2B in the northeast-southwest orientation.

Notably, it is also possible to reconfigure the antenna element 22 to radiate the electromagnetic wave in a circular polarization. In this regard, as further discussed in FIG. 7C below, the first differential signal 40 and the second differential signal 42 will be so generated to have a 90° relative phase differential.

Figure 4:
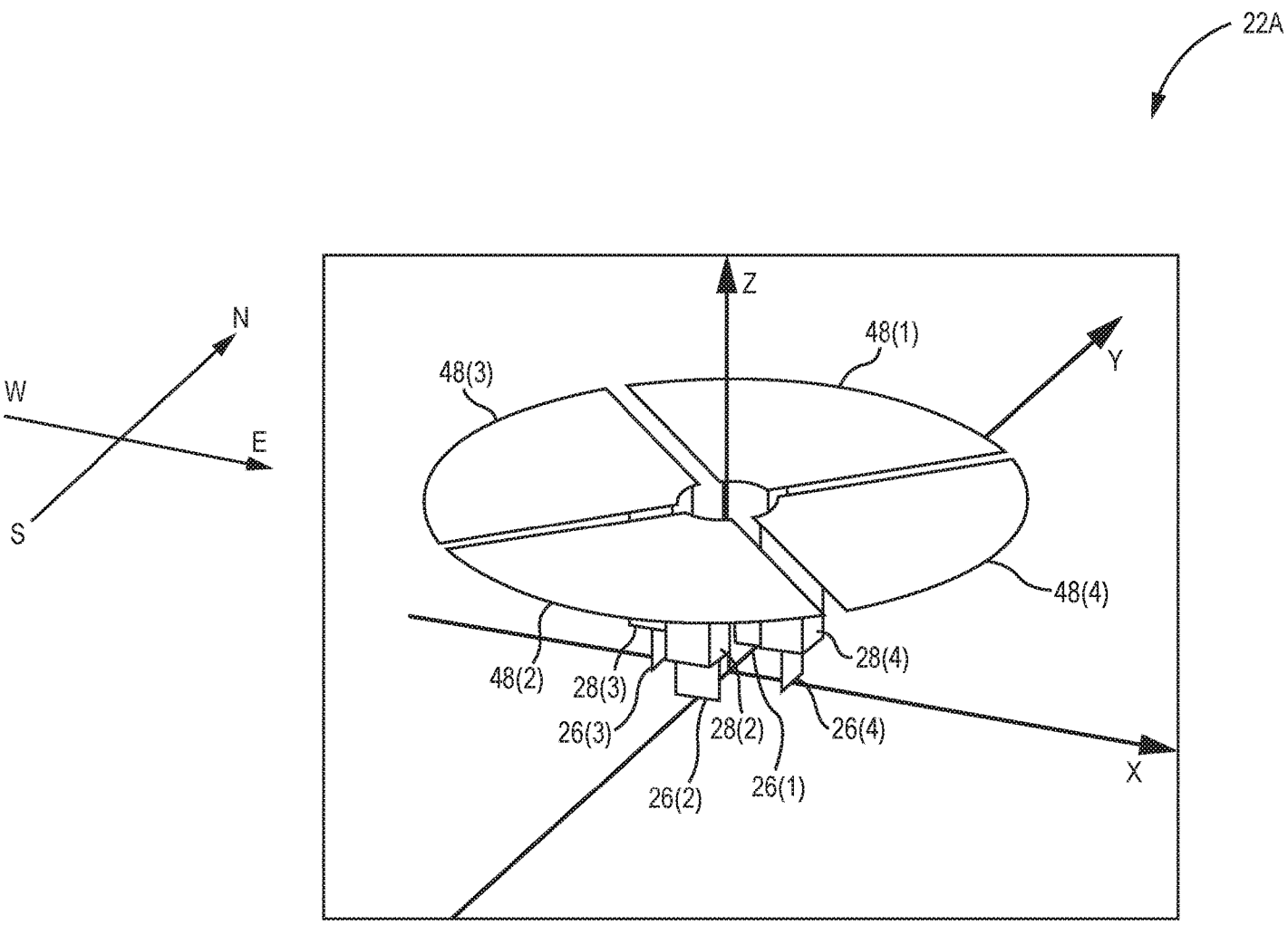
FIG. 4 is a schematic diagram providing a 3D view of an exemplary antenna element configured according to another embodiment of the present disclosure.

FIG. 4 is a schematic diagram providing a 3D view of an exemplary antenna element 22A configured according to another embodiment of the present disclosure. Common elements between FIGS. 2A and 4 are shown therein with common element numbers and will not be re-described herein.

The antenna element 22A includes a first quarter-circular-shaped monopole antenna 48(1), a second quarter-circular-shaped monopole antenna 48(2), a third quarter-circular-shaped monopole antenna 48(3), and a fourth quarter-circular-shaped monopole antenna 48(4) that collectively form the radiating structure of the antenna element 22A. The antenna element 22A can be dynamically reconfigured based on the same principles as described in FIGS. 2A-2B and 3A-3D to radiate the electromagnetic wave in linear and circular polarizations.

Figure 5B:
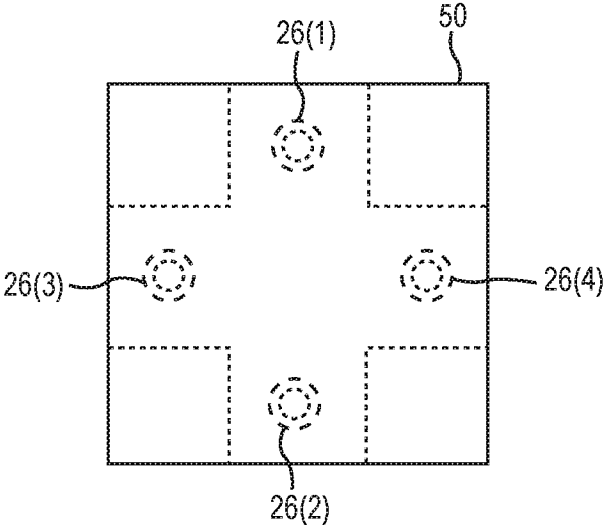
FIG. 5B is a schematic diagram providing an exemplary top view of the antenna element of FIG. 5A.
Figure 5A:
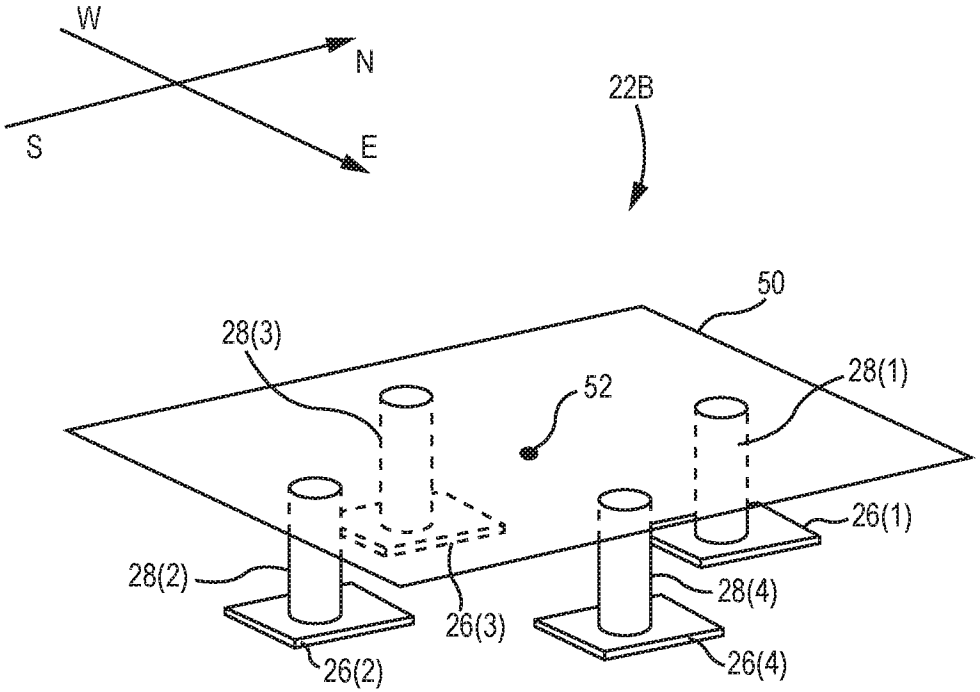
FIG. 5A is a schematic diagram providing a 3D view of an exemplary antenna element configured according to another embodiment of the present disclosure.

FIG. 5A is a schematic diagram providing a 3D view of an exemplary antenna element 22B configured according to another embodiment of the present disclosure. Common elements between FIGS. 2A and 5A are shown therein with common element numbers and will not be re-described herein.

The antenna element 22B includes a planar patch antenna 50 that forms the radiating structure of the antenna element 22B. The planar patch antenna 50 can be in any geometric plane shape deemed suitable. In a non-limiting example, the planar patch antenna 50 as shown in FIG. 5 is a rectangular-shaped planar patch antenna. The first pair of feed ports 26(1), 26(2) and the second pair of feed ports 26(3), 26(4) may be provided according to a symmetrical arrangement relative to a defined geometric center 52 of the planar patch antenna 50. The antenna element 22B can be dynamically reconfigured based on the same principles as described in FIGS. 2A-2B and 3A-3D to radiate the electromagnetic wave in linear and circular polarizations.

Figure 6:
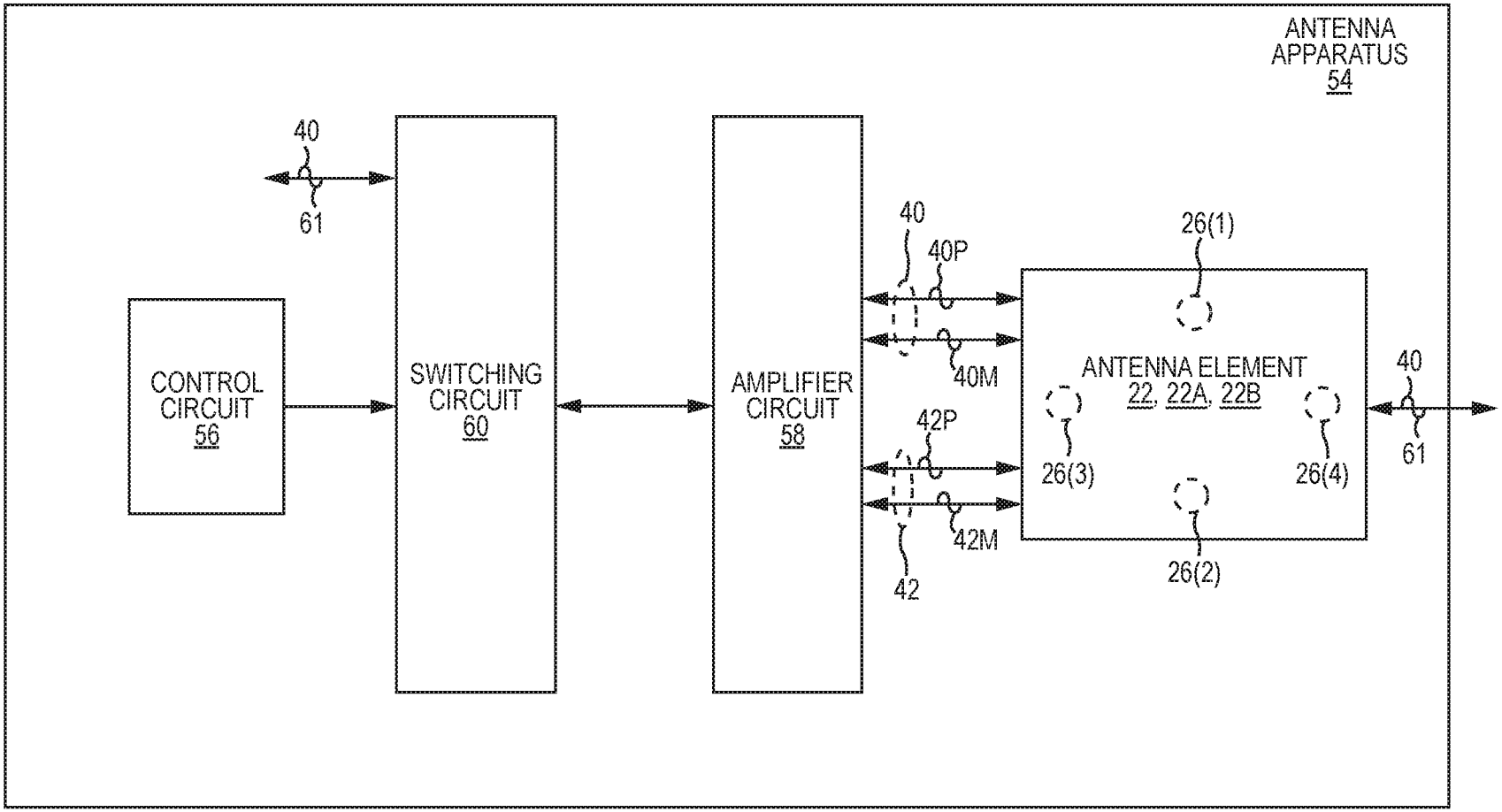
FIG. 6 is a schematic diagram of an exemplary antenna apparatus incorporating the antenna element of FIGS. 2A, 4, and 5A.

The antenna element 22 of FIGS. 2A-2B, the antenna element 22A of FIG. 4, and the antenna element 22B of FIGS. 5A-5B can be provided in an antenna apparatus. In this regard, FIG. 6 is a schematic diagram of an exemplary antenna apparatus 54 incorporating the antenna element 22 of FIG. 2A, the antenna element 22A of FIG. 4, and the antenna element 22B of FIG. 5A. Common elements between FIGS. 2A, 4, 5A, and 6 are shown therein with common element numbers and will not be re-described herein.

The antenna apparatus 54 includes a control circuit 56, which can be a microprocessor, a microcontroller, or a field-programmable gate array (FPGA), for example. The control circuit 56 is configured to cause the first differential signal 40 and/or the second differential signal 42 being provided to the first pair of feed ports 26(1), 26(2) and/or the second pair of feed ports 26(3), 26(4) to further cause the antenna element 22, 22A, or 22B to radiate in the defined polarization.

The antenna apparatus 54 further includes an amplifier circuit 58 and a switching circuit 60. The amplifier circuit 58 is coupled between the switching circuit 60 and the antenna element 22, 22A, or 22B. The switching circuit 60 may be configured to receive the first differential signal 40 from a transceiver circuit (not shown). The control circuit 56 can be configured to control the switching circuit 60 to generate the first differential signal 40 and the second differential signal 42 based on the first differential signal 40. The amplifier circuit 58 is configured to amplify and provide the first differential signal 40 and/or the second differential signal 42 to the first pair of feed ports 26(1), 26(2) and/or the second pair of feed ports 26(3), 26(4). The switching circuit 60 is coupled to the control circuit 56 and the amplifier circuit 58. In a non-limiting example, the control circuit 56 can control the switching circuit 60 to route the first differential signal 40 and/or the second differential signal 42 to the first pair of feed ports 26(1), 26(2) and/or the second pair of feed ports 26(3), 26(4). It should be appreciated that the antenna apparatus 54 can be further configured to absorb an incoming RF signal 61 and propagate the incoming RF signal 61 toward the transceiver circuit (not shown). Some exemplary embodiments of the antenna apparatus 54 are discussed now with reference to FIGS. 7A-7C.

Figure 7A:
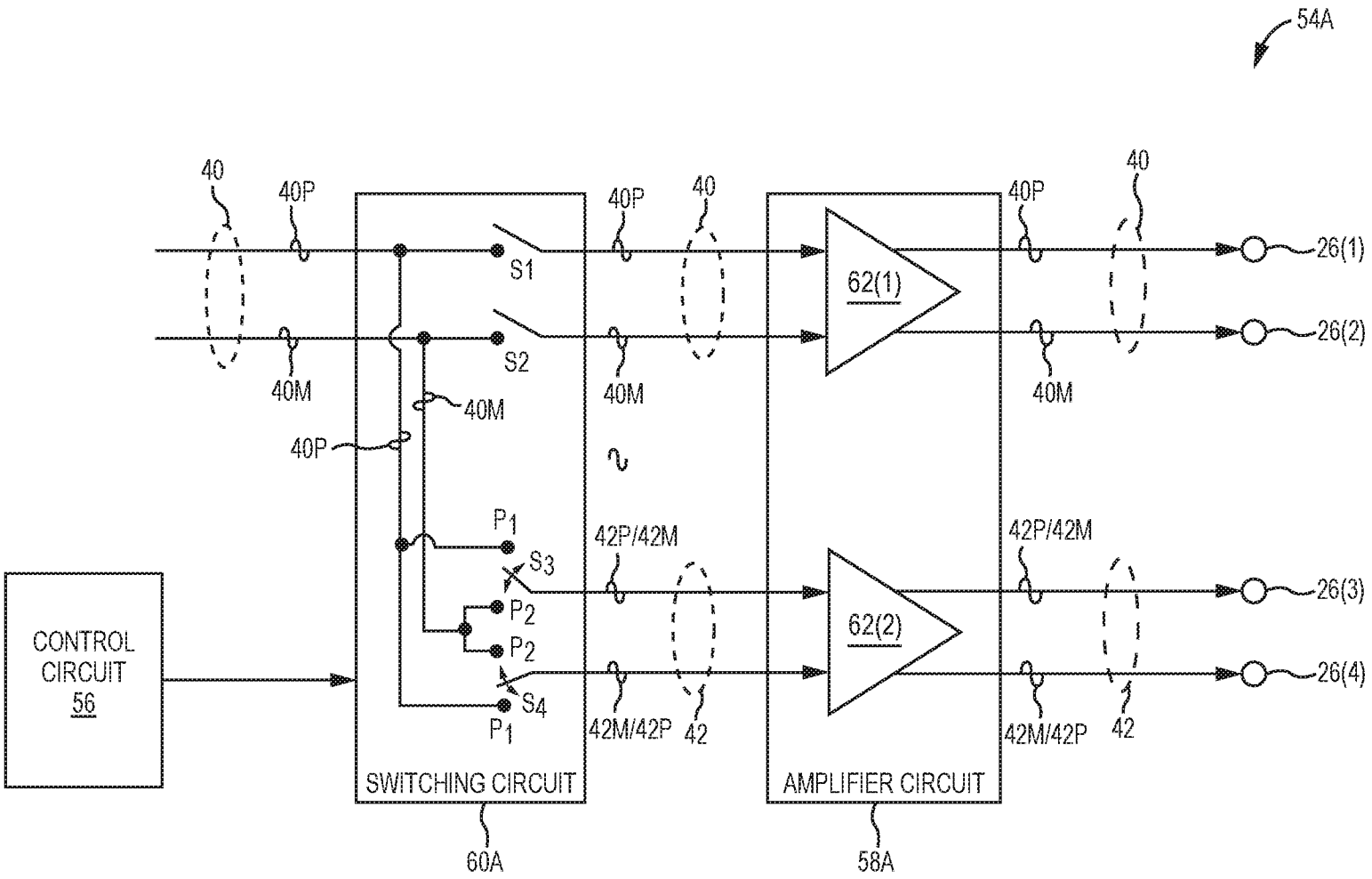
FIG. 7A is a schematic diagram of an exemplary antenna apparatus configured according to one embodiment of the present disclosure.

FIG. 7A is a schematic diagram of an exemplary antenna apparatus 54A configured according to one embodiment of the present disclosure. Common elements between FIGS. 6 and 7A are shown therein with common element numbers and will not be re-described herein.

The antenna apparatus 54A includes an amplifier circuit 58A and a switching circuit 60A. The amplifier circuit 58A includes a first differential amplifier 62(1) and a second differential amplifier 62(2). The first differential amplifier 62(1) is coupled to the first pair of feed ports 26(1), 26(2) and configured to receive and amplify the first positive signal 40P and the first negative signal 40M. Accordingly, the first differential amplifier 62(1) provides the first positive signal 40P and the first negative signal 40M to the first pair of feed ports 26(1), 26(2), respectively.

The second differential amplifier 62(2) is coupled to the second pair of feed ports 26(3), 26(4). In one embodiment, the second differential amplifier 62(2) is configured to receive and amplify the second positive signal 42P and the second negative signal 42M. Accordingly, the second differential amplifier 62(2) provides the second positive signal 42P and the second negative signal 42M to the second pair of feed ports 26(3), 26(4), respectively. In another embodiment, the second differential amplifier 62(2) is configured to receive and amplify the second negative signal 42M and the second positive signal 42P. Accordingly, the second differential amplifier 62(2) provides the second negative signal 42M and the second positive signal 42P to the second pair of feed ports 26(3), 26(4), respectively.

The switching circuit 60A receives the first differential signal 40 consisting of the first positive signal 40P and the first negative signal 40M. The first differential signal 40 may be generated in a respective phase by, for example, a transceiver circuit (not shown). The switching circuit 60A may optionally include a first switch $S_1$, a second switch $S_2$, a third switch $S_3$ and a fourth switch $S_4$. The control circuit 56 may control the switching circuit 60A to close the first switch $S_1$ and the second switch $S_2$, while keeping the third switch $S_3$ and the fourth switch $S_4$ open, thus providing the first differential signal 40 to the first differential amplifier 62(1). The control circuit 56 may control the switching circuit 60A to open the first switch $S_1$ and the second switch $S_2$. In this regard, the first differential amplifier 62(1) will not receive the first differential signal 40. As a result, the first differential signal 40 will not be provided to the first pair of feed ports 26(1), 26(2).

In a non-limiting example, each of the third switch $S_3$ and the fourth switch $S_4$ can be a single-pole double-throw (SP2T) switch having a first throw port $P_1$ and a second throw port $P_2$. The first throw port $P_1$ in each of the third switch $S_3$ and the fourth switch $S_4$ is configured to receive the first positive signal 40P. The second throw port $P_2$ in each of the third switch $S_3$ and the fourth switch $S_4$ is configured to receive the first negative signal 40M.

In one embodiment, the control circuit 56 may control the switching circuit 60A to couple the third switch $S_3$ and the fourth switch $S_4$ to the first throw port $P_1$ and the second throw port $P_2$, respectively. In this regard, the first positive signal 40P and the first negative signal 40M are provided to the second differential amplifier 62(2) as the second positive signal 42P and the second negative signal 42M, respectively. Accordingly, the second differential amplifier 62(2) provides the second positive signal 42P and the second negative signal 42M to the second pair of feed ports 26(3), 26(4), respectively.

In another embodiment, the control circuit 56 may control the switching circuit 60A to couple the third switch $S_3$ and the fourth switch $S_4$ to the second throw port $P_2$ and the first throw port $P_1$, respectively. In this regard, the first negative signal 40M and the first positive signal 40P are provided to the second differential amplifier 62(2) as the second negative signal 42M and the second positive signal 42P, respectively. Accordingly, the second differential amplifier 62(2) provides the second negative signal 42M and the second positive signal 42P to the second pair of feed ports 26(3), 26(4), respectively. Given that the second differential signal 42 is generated based on the first differential signal 40, the first differential signal 40 and the second differential signal 42 inherently have a 0° relative phase differential. Notably, the control circuit 56 may toggle the third switch $S_3$ and the fourth switch $S_4$ while keeping the first switch $S_1$ and the second switch $S_2$ closed. Alternatively, the control circuit 56 may also toggle the third switch $S_3$ and the fourth switch $S_4$ while keeping the first switch $S_1$ and the second switch $S_2$ open.

Figure 7B:
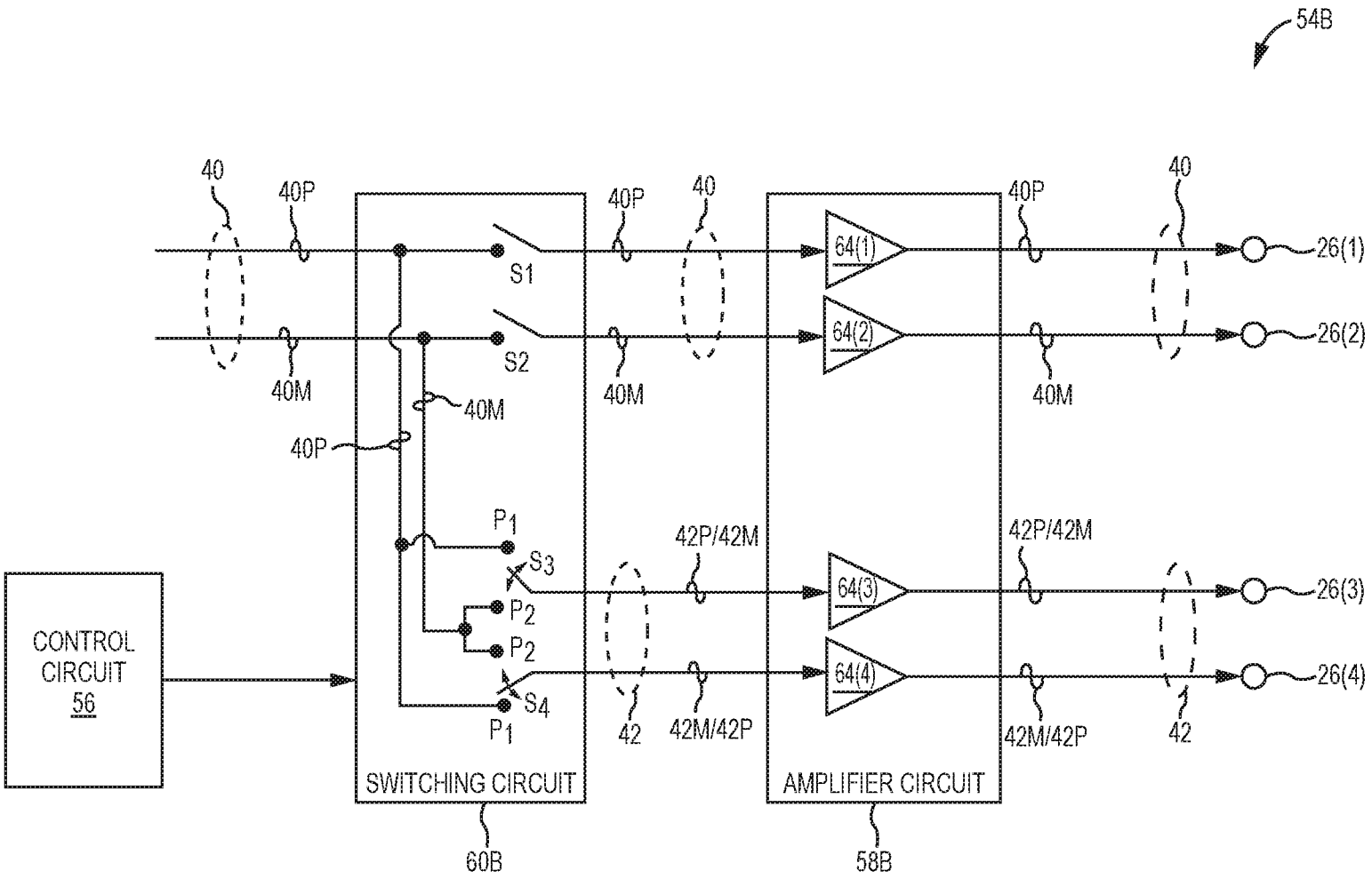
FIG. 7B is a schematic diagram of an exemplary antenna apparatus configured according to another embodiment of the present disclosure.

FIG. 7B is a schematic diagram of an exemplary antenna apparatus 54B configured according to another embodiment of the present disclosure. Common elements between FIGS. 7A and 7B are shown therein with common element numbers and will not be re-described herein.

The antenna apparatus 54B includes an amplifier circuit 58B and a switching circuit 60B. The switching circuit 60B is identical to the switching circuit 60A of FIG. 7A and thus will not be re-described herein.

The amplifier circuit 58B includes a first single-ended amplifier 64(1), a second single-ended amplifier 64(2), a third single-ended amplifier 64(3), and a fourth single-ended amplifier 64(4). The first single-ended amplifier 64(1) and the second single-ended amplifier 64(2) are configured to receive and amplify the first positive signal 40P and the first negative signal 40M, respectively. Accordingly, the first single-ended amplifier 64(1) and the second single-ended amplifier 64(2) provide the first positive signal 40P and the first negative signal 40M of the first differential signal 40 to the first pair of feed ports 26(1), 26(2), respectively.

The third single-ended amplifier 64(3) and the fourth single-ended amplifier 64(4) are coupled to the second pair of feed ports 26(3), 26(4). In one embodiment, the third single-ended amplifier 64(3) and the fourth single-ended amplifier 64(4) are configured to receive and amplify the second positive signal 42P and the second negative signal 42M, respectively. Accordingly, the third single-ended amplifier 64(3) and the fourth single-ended amplifier 64(4) provide the second positive signal 42P and the second negative signal 42M to the second pair of feed ports 26(3), 26(4), respectively. In another embodiment, the third single-ended amplifier 64(3) and the fourth single-ended amplifier 64(4) are configured to receive and amplify the second negative signal 42M and the second positive signal 42P, respectively. Accordingly, the third single-ended amplifier 64(3) and the fourth single-ended amplifier 64(4) provide the second negative signal 42M and the second positive signal 42P to the second pair of feed ports 26(3), 26(4), respectively.

Figure 7C:
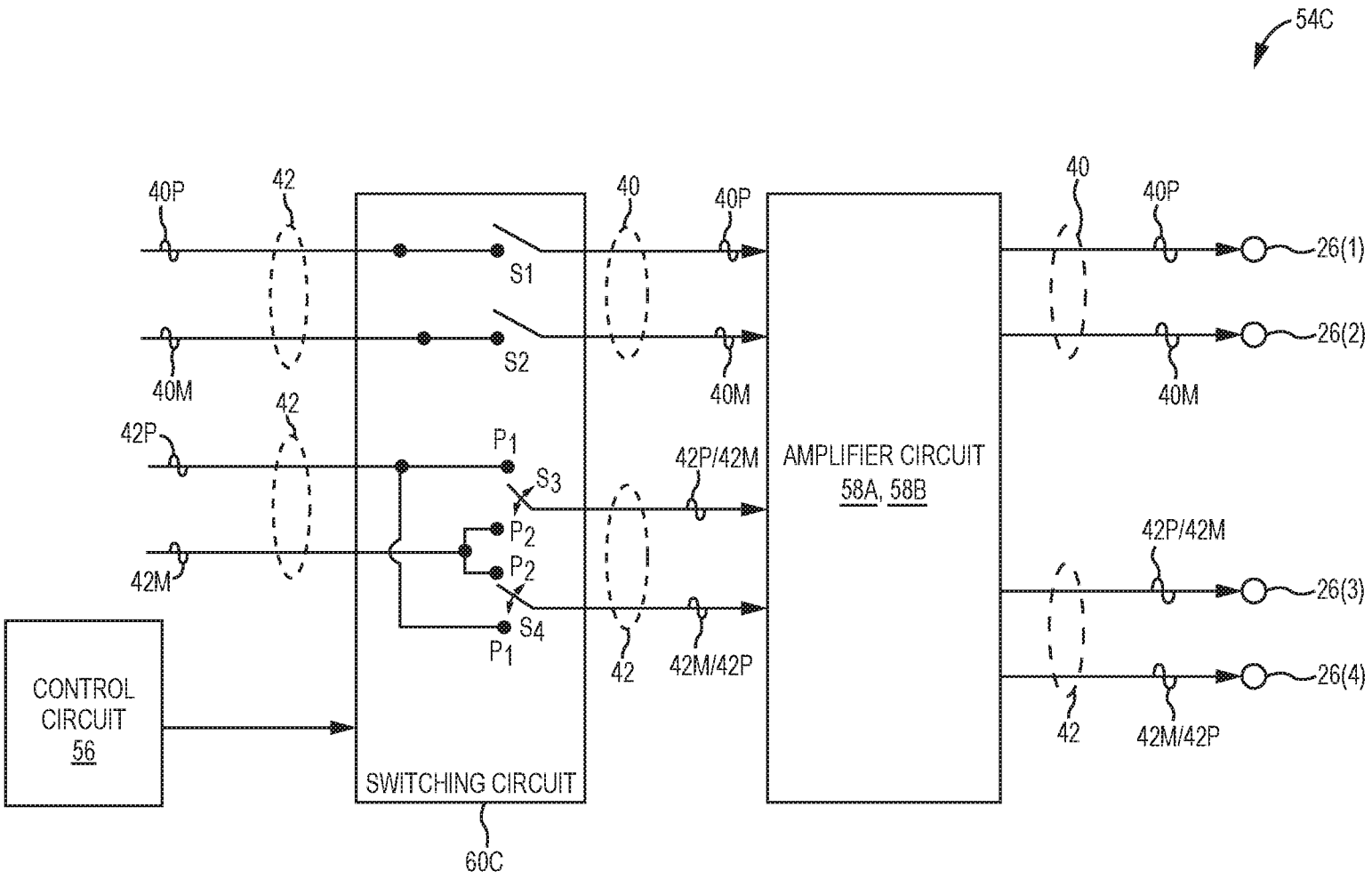
FIG. 7C is a schematic diagram of an exemplary antenna apparatus configured according to another embodiment of the present disclosure.

FIG. 7C is a schematic diagram of an exemplary antenna apparatus 54C configured according to another embodiment of the present disclosure. Common elements between FIGS. 7A, 7B, and 7C are shown therein with common element numbers and will not be re-described herein.

The antenna apparatus 54C can include either the amplifier circuit 58A of FIG. 7A or the amplifier circuit 58B of FIG. 7B. The antenna apparatus 54C also includes a switching circuit 60C. In contrast to the switching circuit 60A of FIG. 7A and the switching circuit 60B of FIG. 7B, the switching circuit 60C receives both the first differential signal 40 and the second differential signal 42. The first differential signal 40 and the second differential signal 42 may be generated in respective phases by, for example, a transceiver circuit (not shown). In this regard, the first differential signal 40 and the second differential signal 42 may have a relative phase differential (e.g., 90°).

The switching circuit 60C includes a first switch $S_1$ and a second switch $S_2$. The control circuit 56 may control the switching circuit 60C to close the first switch $S_1$ and the second switch $S_2$, thus providing the first differential signal 40 to the first differential amplifier 62(1). The control circuit 56 may control the switching circuit 60C to open the first switch $S_1$ and the second switch $S_2$. In this regard, the first differential signal 40 will not be provided to the first pair of feed ports 26(1), 26(2).

The switching circuit 60C also includes a third switch $S_3$ and a fourth switch $S_4$. In a non-limiting example, each of the third switch $S_3$ and the fourth switch $S_4$ can be a SP2T switch having a first throw port $P_1$ and a second throw port $P_2$. The first throw port $P_1$ in each of the third switch $S_3$ and the fourth switch $S_4$ is configured to receive the second positive signal 42P. The second throw port $P_2$ in each of the third switch $S_3$ and the fourth switch $S_4$ is configured to receive the second negative signal 42M.

In one embodiment, the control circuit 56 may control the switching circuit 60C to couple the third switch $S_3$ and the fourth switch $S_4$ to the first throw port $P_1$ and the second throw port $P_2$, respectively. In this regard, the second positive signal 42P and the second negative signal 42M are provided to the second pair of feed ports 26(3), 26(4), respectively.

In another embodiment, the control circuit 56 may control the switching circuit 60C to couple the third switch $S_3$ and the fourth switch $S_4$ to the second throw port $P_2$ and the first throw port $P_1$, respectively. In this regard, the second negative signal 42M and the second positive signal 42P are provided to the second pair of feed ports 26(3), 26(4), respectively.

Those skilled in the art will recognize improvements and modifications to the preferred embodiments of the present disclosure. All such improvements and modifications are considered within the scope of the concepts disclosed herein and the claims that follow.

What is claimed is:

1. An antenna element comprising:

a three-dimensional (3D) structure comprising a substrate layer having a first surface and a second surface;

a radiating structure disposed on the first surface of the substrate layer and configured to radiate in a plurality of polarizations;

a first pair of feed ports disposed on the second surface of the substrate layer and conductively coupled to the radiating structure, the first pair of feed ports disposed linearly in a first axis parallel to the radiating structure;

a second pair of feed ports disposed on the second surface of the substrate layer and conductively coupled to the radiating structure, the second pair of feed ports disposed linearly in a second axis parallel to the radiating structure and perpendicular to the first axis;

a first pair of conductive structures extending vertically through the substrate layer to conductively couple the radiating structure to the first pair of feed ports, respectively; and a second pair of conductive structures extending vertically through the substrate layer to conductively couple the radiating structure to the second pair of feed ports, respectively;

wherein:

the first pair of feed ports is configured to receive a first differential signal to cause the radiating structure to radiate in a first of the plurality of polarizations; and the second pair of feed ports is configured to receive a second differential signal to cause the radiating structure to radiate in a second of the plurality of polarizations.

2. The antenna element of claim 1 wherein:

the radiating structure corresponds to a defined geometric center; and the first pair of feed ports and the second pair of feed ports are disposed symmetrically relative to the defined geometric center.

3. The antenna element of claim 1 wherein:

the radiating structure corresponds to a defined geometric center; and the first pair of feed ports and the second pair of feed ports are disposed asymmetrically relative to the defined geometric center.

4. The antenna element of claim 1 wherein the first axis and the second axis are north-south oriented and west-east oriented, respectively.

5. The antenna element of claim 4 wherein the first of the plurality of polarizations corresponds to a north-south oriented linear polarization.

6. The antenna element of claim 4 wherein the second of the plurality of polarizations corresponds to a west-east oriented linear polarization.

7. The antenna element of claim 4 wherein the first pair of feed ports and the second pair of feed ports are configured to receive the first differential signal and the second differential signal concurrently, the first differential signal and the second differential signal having a relative phase differential configured to cause the radiating structure to radiate in a northwest-southeast oriented polarization or a northeast-southwest oriented polarization among the plurality of polarizations.

8. The antenna element of claim 4 wherein the first pair of feed ports and the second pair of feed ports are configured to receive the first differential signal and the second differential signal concurrently, the first differential signal and the second differential signal having a relative phase differential configured to cause the radiating structure to radiate in a circular polarization among the plurality of polarizations.

9. The antenna element of claim 1 wherein the radiating structure comprises:

a first rectangular-shaped monopole antenna conductively coupled to one of the first pair of feed ports;

a second rectangular-shaped monopole antenna conductively coupled to another one of the first pair of feed ports;

a third rectangular-shaped monopole antenna conductively coupled to one of the second pair of feed ports; and a fourth rectangular-shaped monopole antenna conductively coupled to another one of the second pair of feed ports;

wherein:

the first rectangular-shaped monopole antenna and the second rectangular-shaped monopole antenna are linearly aligned in a north-south orientation; and the third rectangular-shaped monopole antenna and the fourth rectangular-shaped monopole antenna are linearly aligned in a west-east orientation perpendicular to the north-south orientation.

10. The antenna element of claim 9 wherein:

the first rectangular-shaped monopole antenna and the second rectangular-shaped monopole antenna are configured to receive the first differential signal in positive and negative polarities, respectively;

the third rectangular-shaped monopole antenna and the fourth rectangular-shaped monopole antenna are configured to receive the second differential signal in the positive and negative polarities, respectively; and the first differential signal and the second differential signal have a zero degree relative phase differential to cause the radiating structure to radiate in a northwest-southeast oriented linear polarization among the plurality of polarizations.

11. The antenna element of claim 9 wherein:

the first rectangular-shaped monopole antenna and the second rectangular-shaped monopole antenna are configured to receive the first differential signal in positive and negative polarities, respectively;

the fourth rectangular-shaped monopole antenna and the third rectangular-shaped monopole antenna are configured to receive the second differential signal in the positive and negative polarities, respectively; and the first differential signal and the second differential signal have a zero degree relative phase differential to cause the radiating structure to radiate in a northeast-southwest oriented linear polarization among the plurality of polarizations.

12. The antenna element of claim 1 wherein the radiating structure comprises:

a first quarter-circular-shaped monopole antenna conductively coupled to one of the first pair of feed ports;

a second quarter-circular-shaped monopole antenna conductively coupled to another one of the first pair of feed ports;

a third quarter-circular-shaped monopole antenna conductively coupled to one of the second pair of feed ports; and a fourth quarter-circular-shaped monopole antenna conductively coupled to another one of the second pair of feed ports.

13. The antenna element of claim 1 wherein the radiating structure comprises a planar patch antenna in a defined geometric plane shape and is conductively coupled to the first pair of feed ports and the second pair of feed ports.

14. The antenna element of claim 13 wherein:

the planar patch antenna is a rectangular-shaped patch antenna having a defined geometric center; and the first pair of feed ports and the second pair of feed ports are provided in a symmetrical arrangement relative to the defined geometric center.

15. An antenna apparatus comprising:

an antenna element comprising:

a three-dimensional (3D) structure comprising a substrate layer having a first surface and a second surface;

a radiating structure disposed on the first surface of the substrate layer and configured to radiate in a plurality of polarizations;

a first pair of feed ports disposed on the second surface of the substrate layer and conductively coupled to the radiating structure, the first pair of feed ports disposed linearly in a first axis parallel to the radiating structure; and a second pair of feed ports disposed on the second surface of the substrate layer and conductively coupled to the radiating structure, the second pair of feed ports disposed linearly in a second axis parallel to the radiating structure and perpendicular to the first axis;

a first pair of conductive structures extending vertically through the substrate layer to conductively couple the radiating structure to the first pair of feed ports, respectively; and a second pair of conductive structures extending vertically through the substrate layer to conductively couple the radiating structure to the second pair of feed ports, respectively; and a control circuit configured to:

cause a first differential signal being provided to the first pair of feed ports to cause the radiating structure to radiate in a first of the plurality of polarizations; and cause a second differential signal being provided to the second pair of feed ports to cause the radiating structure to radiate in a second of the plurality of polarizations.

16. The antenna apparatus of claim 15 further comprising:

an amplifier circuit coupled to the first pair of feed ports and the second pair of feed ports; and a switching circuit coupled to the amplifier circuit and the control circuit.

17. The antenna apparatus of claim 16 wherein the amplifier circuit comprises:

a first differential amplifier coupled to the first pair of feed ports; and a second differential amplifier coupled to the second pair of feed ports.

18. The antenna apparatus of claim 16 wherein the amplifier circuit comprises:

a first single-ended amplifier coupled to one of the first pair of feed ports;

a second single-ended amplifier coupled to another one of the first pair of feed ports;

a third single-ended amplifier coupled to one of the second pair of feed ports; and a fourth single-ended amplifier coupled to another one of the second pair of feed ports.

19. The antenna apparatus of claim 15 wherein the radiating structure comprises:

a first rectangular-shaped monopole antenna conductively coupled to one of the first pair of feed ports;

a second rectangular-shaped monopole antenna conductively coupled to another one of the first pair of feed ports;

a third rectangular-shaped monopole antenna conductively coupled to one of the second pair of feed ports; and a fourth rectangular-shaped monopole antenna conductively coupled to another one of the second pair of feed ports;

wherein:

the first rectangular-shaped monopole antenna and the second rectangular-shaped monopole antenna are linearly aligned in a north-south orientation; and the third rectangular-shaped monopole antenna and the fourth rectangular-shaped monopole antenna are linearly aligned in a west-east orientation perpendicular to the north-south orientation.

20. The antenna apparatus of claim 19 wherein:

the first rectangular-shaped monopole antenna and the second rectangular-shaped monopole antenna are configured to receive the first differential signal in positive and negative polarities, respectively;

the third rectangular-shaped monopole antenna and the fourth rectangular-shaped monopole antenna are configured to receive the second differential signal in the positive and negative polarities, respectively; and the first differential signal and the second differential signal have a zero degree relative phase differential to cause the radiating structure to radiate in a northwest-southeast oriented linear polarization among the plurality of polarizations.

21. The antenna apparatus of claim 19 wherein:

the first rectangular-shaped monopole antenna and the second rectangular-shaped monopole antenna are configured to receive the first differential signal in positive and negative polarities, respectively;

the fourth rectangular-shaped monopole antenna and the third rectangular-shaped monopole antenna are configured to receive the second differential signal in the positive and negative polarities, respectively; and the first differential signal and the second differential signal have a zero degree relative phase differential to cause the radiating structure to radiate in a northeast-southwest oriented linear polarization among the plurality of polarizations.

22. The antenna apparatus of claim 15 wherein the radiating structure comprises:

a first quarter-circular-shaped monopole antenna conductively coupled to one of the first pair of feed ports;

a second quarter-circular-shaped monopole antenna conductively coupled to another one of the first pair of feed ports;

a third quarter-circular-shaped monopole antenna conductively coupled to one of the second pair of feed ports; and a fourth quarter-circular-shaped monopole antenna conductively coupled to another one of the second pair of feed ports.

23. The antenna apparatus of claim 15 wherein the radiating structure comprises a planar patch antenna in a defined geometric plane shape and is conductively coupled to the first pair of feed ports and the second pair of feed ports.

* * * * *